US005729243A

United States Patent [19]

Cavallerano et al.

[11] Patent Number: 5,729,243

[45] Date of Patent: Mar. 17, 1998

[54] MULTI-FRAME-RATE OPERATION OF DIGITAL LIGHT-MODULATORS

[75] Inventors: Alan P. Cavallerano; Claudio Ciacci, both of White Plains, N.Y.

[73] Assignee: Philips Electronics North-America Corporation, New York, N.Y.

[21] Appl. No.: 576,548

[22] Filed: Dec. 21, 1995

[51] Int. Cl.[6] ..... G09G 3/00

[52] U.S. Cl. ..... 345/59; 348/770; 348/771; 375/364

[58] Field of Search ..... 345/59; 348/444, 348/770, 771; 375/364; 395/551

[56] References Cited

U.S. PATENT DOCUMENTS

| | | | |
|---|---|---|---|
| 5,068,649 | 11/1991 | Garrett | 345/89 |
| 5,079,544 | 1/1992 | Demond et al. | 345/84 |
| 5,319,214 | 6/1994 | Gregory et al. | 250/504 R |
| 5,452,024 | 9/1995 | Sampsell | 348/770 X |
| 5,493,439 | 2/1996 | Engle | 359/292 |
| 5,508,750 | 4/1996 | Hewlett et al. | 348/558 |
| 5,570,297 | 10/1996 | Brzezinski et al. | 364/514 R |
| 5,588,029 | 12/1996 | Maturi et al. | 375/364 |
| 5,619,228 | 4/1997 | Doherty | 345/148 |

OTHER PUBLICATIONS

Hornbeck, "Deformable-Mirror Spatial Light Modulators", SPIE Critical Reviews Series vol. 1150 (1990), pp. 86–102.

Boysel, "A 128×128 Frame-Addressed Deformable Mirror Spatial Light Modulator", Optical Engineering, Sep. 1991, vol. 30, No. 9, pp. 1422–1427.

Schrieber, "Fundamentals of Electronic Imaging Systems Some Aspects of Image Processing", pp. 100–103, Springer-Verlag.

HD5100, Snell & Wilcox, HDTV Upconversion.

U.S. Patent Application Ser. No. 08/495,290 (PNA 21992).

*Primary Examiner*—Raymond J. Bayerl
*Assistant Examiner*—Seth D. Vail
*Attorney, Agent, or Firm*—John C. Fox

[57] ABSTRACT

A matrix display of light reflecting elements is capable of displaying images represented by data codes received from a variety of different sources at different respective frame rates. The codes are stored at whatever frame rate they are received, but are read at a subframe rate which is an integral multiple of each of the different frame rates.

6 Claims, 7 Drawing Sheets

MULTI-FRAME-RATE OPERATION OF DIGITAL LIGHT-MODULATORS

BACKGROUND OF THE INVENTION

1. Field of the Invention

The invention relates to the utilization of an array of digital light modulating elements to display an image.

2. Description of Related Art

A digital light modulating element is one which is capable of modulating incident light to two different luminance levels. In the simplest case, either a bright or a dark light level would be produced. Typically the element is either light reflective or light transmissive. An advantage of this type of element is that it enables a display apparatus to be constructed which can be operated totally by the application of digital signals. This facilitates integration of the display and of associated digital drive circuitry on a chip.

Examples of devices having light modulating elements of this type are the well known liquid crystal device (LCD) and the less well known deformable-mirror spatial light modulator. A particular type of the spatial light modulator is the deformable-mirror device (DMD), which is described by Larry J. Hornbeck in "Deformable-Mirror Spatial Light Modulators", SPIE, Vol. 1150, pages 86–102 (1990), which is hereby incorporated by reference. The DMD incorporates, on an integrated circuit chip, a matrix array of individually-addressable, electrostatically-deflectable mirrors. Each mirror produces one light-modulated pixel of an image (e.g. figures, symbols or text) to be presented to a viewer.

U.S. Pat. No. 5,079,544, which is hereby incorporated by reference, describes in detail various display apparatus which utilize DMDs as digital light modulating elements. Three of the drawing figures from that patent are included herein, in slightly modified form as FIGS. 1, 2 and 3, to facilitate a general explanation of the operation of an exemplary DMD.

FIG. 1 is a diagram of a typical DMD integrated circuit chip including a timing circuit 14, an array 16 of deformable mirror cells, a register 18 (e.g. a shift register), and first and second decoders 22 and 24, respectively. The deformable mirror cells may be disposed in a matrix arrangement or in some other convenient arrangement. A typical arrangement is a row-and-column matrix where each cell is disposed at a crossing of a respective row and column conductor or line. This type of arrangement is presumed for purposes of describing and explaining the operation of the array 16. A memory cell, including a plurality of sub-cells for storing respective bits of a multi-bit display code, is associated with each mirror cell.

The register 18 has a number of taps 20 for electrical connection to a bus (not shown) to enable data to be loaded into the register for transfer to respective memory cells in the array. The bus may provide data from a variety of different sources, such as an A/D converter driven by a video source (e.g. a television), a computer or a graphics system. The register 18 also has a number of outputs which are connected to respective column lines $C_1$, $C_2$ . . . $C_N$ of the array 16. Similarly, the decoder 22 has a number of outputs which are connected to respective row lines $R_1$, $R_2$ . . . $R_M$ of the array. Although not shown in FIG. 1, the timing circuit 14 is electrically connected to the register 18 and to the decoders 22 and 24. The decoders themselves each include means, such as shift registers, for sequentially selecting the memory sub-cells in response to timing pulses from the timing circuit. In response to timing signals produced by the timing circuit 14:

register 18 and decoder 22 sequentially select row and column lines to direct data from the register to the memory cells associated with selected mirror cells;

decoder 22 also sequentially selects the memory sub-cells into which data from the register 18 is to be written; and decoder 24 sequentially reads the data from the memory sub-cells to activate the associated mirror cells.

FIG. 2 shows schematically an arbitrary three-bit memory cell of the DMD array 16, electrically connected to row line $R_m$ and column line $C_n$. This figure also shows integrated circuitry associated with this memory cell, the mirror cell $DM_{mn}$ located at the crossing of row line $R_m$ and column line $C_n$, with which the memory cell is associated, and connections to the register 18 and to the decoders 22 and 24.

This and each other memory cell in the array is formed by three single-bit inverting memory sub-cells 54,55,56 for storing respective bits of a three-bit binary display code. The data to be written into this memory cell is provided over column line $C_n$ from a respective output of register 18 to three electrically connected data lines 46,47,48 which, in turn, are selectively connected to inputs of the sub-cells through WRITE switching transistors 36,37,38, respectively. Selection of these transistors is controlled via row line $R_m$ which is formed by a group of three row conductors that are electrically connected to gates of the transistors 36,37,38 via gating lines 32,31,30 respectively. Note that column line $C_n$ is electrically connected to the data lines 46,47,48 of every memory cell in column n. Similarly, row line $R_m$ is electrically connected to the gating lines 32,31,30 of every memory cell in row m.

Reading of the stored data from the memory sub-cells is controlled by the decoder 24 having three outputs which are electrically connected via gating lines 84,85,86 to respective gates of three READ switching transistors 68,69,70. Outputs of the memory sub-cells are selectively connected via these transistors to an input 72 of a single-bit inverting memory cell 74. Note that gating lines 84,85,86 are electrically connected to corresponding READ switching transistors for every memory cell in the array.

The single-bit inverting memory cell 74 has an output electrically connected to the associated mirror cell $DM_{mn}$. Specifically, the output of memory cell 74 is directly electrically connected to a control electrode 128 and is electrically connected through an inverter 129 to a control electrode 130. As is explained in detail in the SPIE article by Hornbeck and in U.S. Pat. No. 5,079,544, which have been incorporated by reference, when memory cell 74 produces a voltage representative of a logical ONE, this voltage effects deflection of reflective mirror element 116 to an ON position represented by the dashed line 118. Conversely, when memory cell 74 produces a voltage representative of a logical ZERO, this voltage effects deflection of reflective mirror element 116 to an OFF position represented by the dashed line 134. In the ON position, the mirror element 116 reflects light (from a source not shown in FIG. 2) and directs it toward a pixel at row m and column n on a display screen, which corresponds with the pixel represented by the memory cell. Conversely, in the OFF position, mirror element 116 directs the light away from the display screen.

FIG. 3 illustrates an example of a way in which different luminance levels are achieved for each pixel, while using the simple ON and OFF approach described above. This figure illustrates the successive illumination of an arbitrary pixel the display screen via the corresponding deformable mirror over six successive image frame periods of duration T. Each frame period is divided into four sub-periods. During the successive periods, the mirror is deflected to achieve a variety of different luminance levels as follows:

During sub-periods $T_1$–$T_4$, the mirror is in its OFF position, directs the light from the source of illumination away from the display screen, and effects the production of a dark pixel.

During sub-periods $T_5$–$T_8$, the mirror is in its ON position, directs the light toward the corresponding pixel on the display screen, and illuminates the pixel to its brightest (100%) state.

During sub-periods $T_9$–$T_{12}$, the mirror is in its OFF position for half of the frame period and is in its ON position for the remaining half of the frame period. The viewer, looking at this pixel, time averages this off and on illumination and interprets or sees the pixel at approximately 50% of its brightest state.

During sub-periods $T_{13}$–$T_{16}$, the mirror is in its OFF position for one quarter of the frame period and is in its ON position for the remaining three quarters of the frame period. The viewer, looking at this pixel, time averages this off and on illumination and sees the pixel at approximately 75% of its brightest state.

The remaining sub-periods ($T_{17}$–$T_{20}$ and $T_{21}$–$T_{24}$) illustrate operation of the mirror for the same relative on and off durations as in sub-periods $T_{13}$–$T_{16}$ and $T_9$–$T_{12}$, respectively, but in the opposite on-off sequence.

In order to achieve different luminance levels for each pixel in the manner just described, time-weighted display codes are stored in the corresponding memory cell. For example, to achieve the mirror-deflection timing illustrated in FIG. 3, a simple three-bit binary code may be utilized, with each higher order bit having twice the weight of the last. As is well known in the art, with this type of weighting eight different values can be represented by a three-bit binary display code. For the four different luminance levels represented in FIG. 3, the binary codes would be "000" (dark), "100" (50% brightness), "110" (75% brightness), and "111" (100% brightness).

Operation of the circuitry of FIG. 2, utilizing such codes to effect time-weighted deflection of the mirror element 116 will now be explained. Just prior to each of the frame periods shown in FIG. 3, the three memory sub-cells 54,55,56 are loaded with the respective bits of the appropriate display code. The three bits of each code are sequentially transmitted over column line $C_n$ while timing pulses are sequentially transmitted over the three row conductors of row line $R_m$ to the respective gating lines 32,31,30 to write the code bits into the memory sub-cells. For purposes of this example, the least significant bit (LSB), next most significant bit, and most significant bit (MSB) are stored in respective memory sub-cells 56,55 and 54. The decoder 24 then effects reading of the three bits by successively applying time-weighted pulses to the gating lines 84,85,86 to cause successive transfer of the bits into the single-bit memory cell 74. The logical values of these bits (i.e. ONE or ZERO), during their storage in memory cell 74, effect corresponding deflections of the mirror element 116.

In practical operation of the disclosed embodiment of FIG. 2, the mirror element cannot be activated 100% of a frame time. Rather, a small part of each frame time T must be devoted to writing the codes into the memory sub-cells. Utilizing the four millisecond frame period set forth as an example in U.S. Pat. No. 5,079,544, one-half millisecond could be devoted to writing the display codes into the respective pixel memory cells, leaving 3.5 milliseconds for deflecting the mirror elements. The time-weighted pulses applied by decoder 24 to gating lines 84,85, and 86 would then have durations of two milliseconds, one millisecond, and one-half millisecond, respectively. In this example, the eight different binary codes obtainable with three bits would effect ON times for the mirror element 116 as listed in the following table:

TABLE I

| Code | ON Time | % of Frame Time |
|---|---|---|
| "000" | 0 ms. | 0 percent |
| "001" | 0.5 ms. | 12.5 percent |
| "010" | 1.0 ms. | 25 percent |
| "011" | 1.5 ms. | 37.5 percent |
| "100" | 2.0 ms. | 50 percent |
| "101" | 2.5 ms. | 62.5 percent |
| "110" | 3.0 ms. | 75 percent |
| "111" | 3.5 ms. | 87.5 percent |

Generally, operation of DMD display apparatus in accordance with the method illustrated in FIG. 3 is satisfactory. An improved version of that method employs longer display codes (e.g. seven-bit codes which are stored in seven-bit memory cells) to provide a greater variety of luminance levels. While this improves the quality of images displayed by the apparatus, it does not correct a disturbing artifact which occurs whenever the eyes of the viewer scan across the image, e.g. to follow a moving object. In this situation, the viewer's visual system incorrectly quantifies the luminance values of certain pixels which are momentarily viewed by the human eye. In other words, the brightness of these pixels seen by the human visual system is in error.

U.S. patent application Ser. No. 08/495,290 (PHA 21992), filed on 27 Jun. 1995, which is hereby incorporated by reference, solves this problem by utilizing a distributed duty cycle approach for the activation of the digital light modulating elements. As in the known approach, each bit of a display code has a value representing either a first state, such as an ON position of a DMD mirror, or a second state, such as an OFF position of a DMD mirror. Also, each bit of the code has a respective weight corresponding to a duration that is equal to a predefined percentage of the frame period. However, rather than activating each digital light modulating element continuously, for the respective durations corresponding to the weights of the bits, the activation of the element into the state represented by a first bit, having a weight which is substantially greater than that of a second bit, is interrupted at least once while the element is activated into the state represented by a different one of the bits in the code.

While this solves the problem of erroneous brightness quantification by the human visual system when the eye scans across a displayed image, it does not adapt the display to operate at different frame rates common to different sources (e.g. television broadcasts, computer-generated images, video-camera signals, . . .). In principle, displays employing digital light modulating elements can be operated at any of the frame rates employed by such sources. However, in order to avoid complicating on-chip circuitry for the digital display, typically the display is designed to operate at a single, fixed frame rate. Thus, if data is received from a source operating at a frame rate which is faster than the fixed frame rate, the display memory for storing the data will overflow, unless some of the data is discarded. This adversely affects the quality of the image presented by the display. Conversely, if data is received from a source operating at a frame rate which is slower than the fixed frame rate, additional "filler" frames of data must be produced. This increases the complexity of the display circuitry.

SUMMARY OF THE INVENTION

It is an object of the invention to provide a method of operating a display apparatus having digital light modulating elements such that it readily displays images represented by data received at different frame rates.

It is yet another object of the invention to provide such a method which permits utilization of the distributed duty cycle sequencing claimed in U.S. patent application Ser. No. 08/495,290 (PHA 21992).

In accordance with the invention, the display apparatus stores successively-received sets of multi-bit codes in memory means at the frame rate in which they are received from the source. However, the codes are read from the memory means at a rate which is an integral multiple of each of the different frame rates, and the digital light modulating elements are activated into the states represented by the read codes. Thus, each frame of received data is stored at the frame reception rate, but is displayed at a faster rate.

In a preferred form of the invention, the data is read from the memory means in a modified form, such as in a distributed duty cycle sequence which makes use of the invention claimed in U.S. patent application Ser. No. 08/495,290 (PHA 21992). Alternatively, the data may be read from the memory means in other modified forms, such as in sequences which effect temporal or spatial filtering. A particular advantage of the invention results from the time division of each received frame into a plurality of displayed subframes. The data for a frame need not be read identically in each of the subframes, but can be read in different forms from subframe to subframe to simultaneously effect a variety of improvements, such as correcting the brightness quantification error and performing temporal and spatial filtering.

DESCRIPTION OF THE PREFERRED EMBODIMENTS

Figure 1:
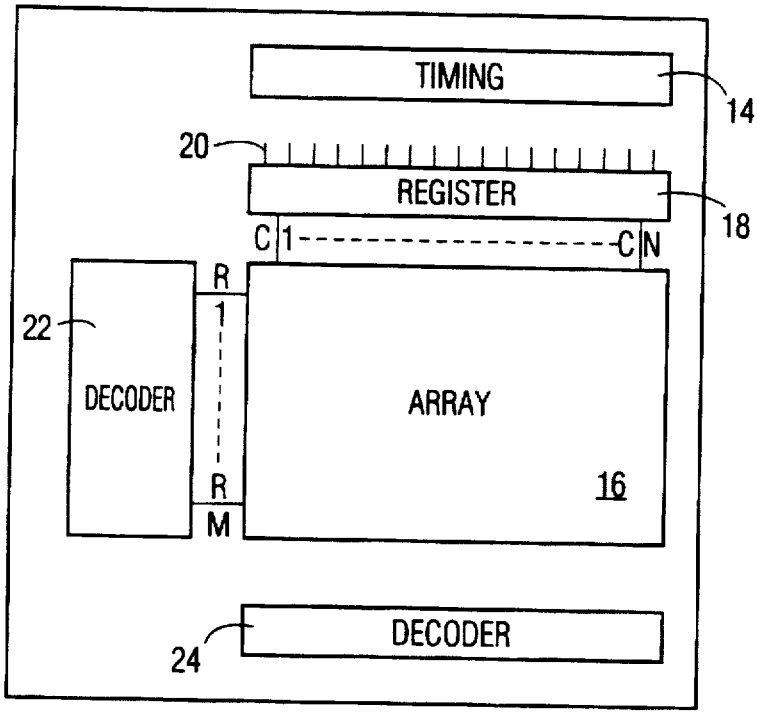
FIG. 1 is a diagram of a known deformable mirror device constructed on a single substrate.
Figure 2:
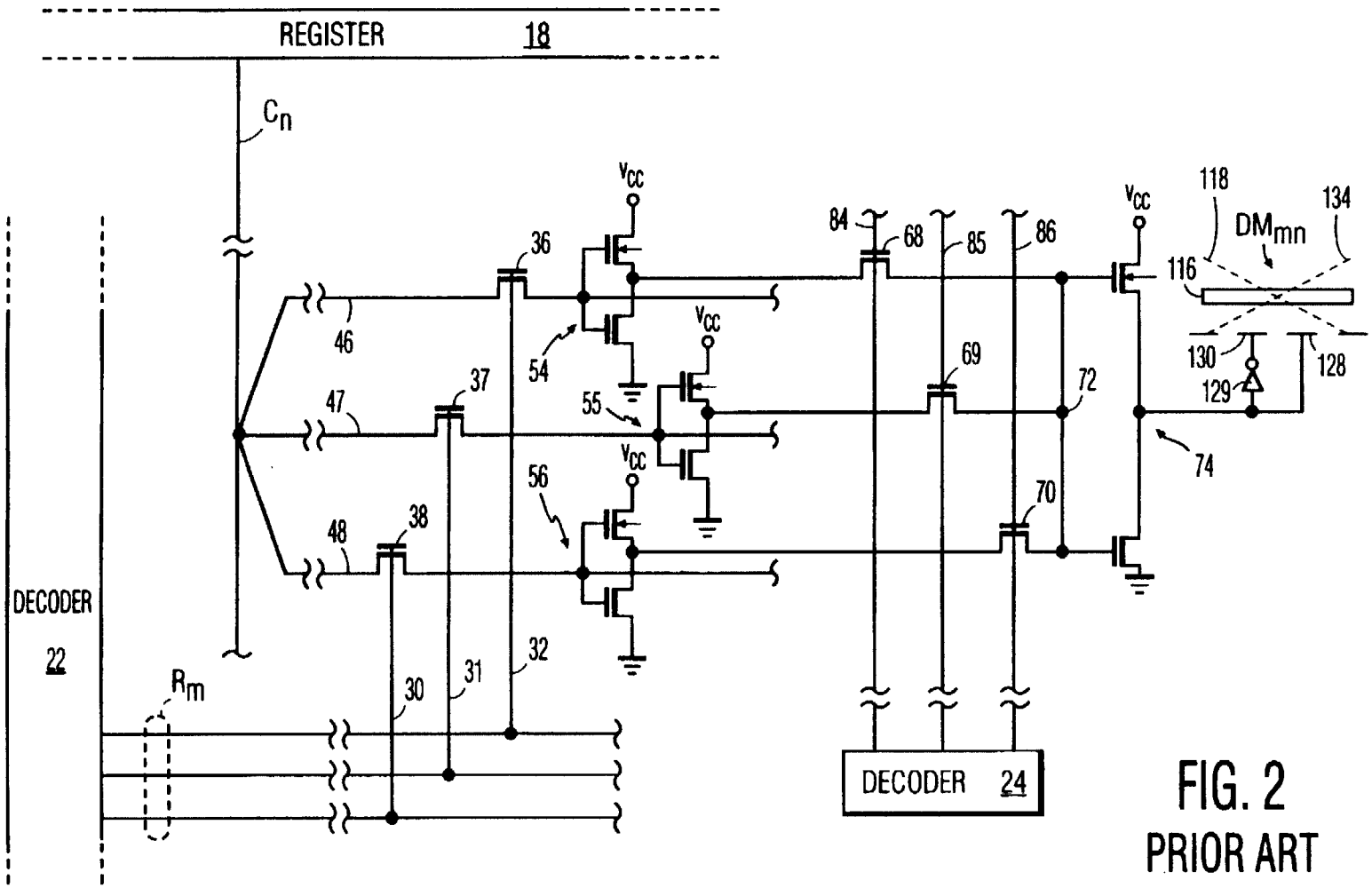
FIG. 2 PRIOR ART
FIG. 2 is a schematic diagram of a single cell of the device of FIG. 1.
Figure 3:
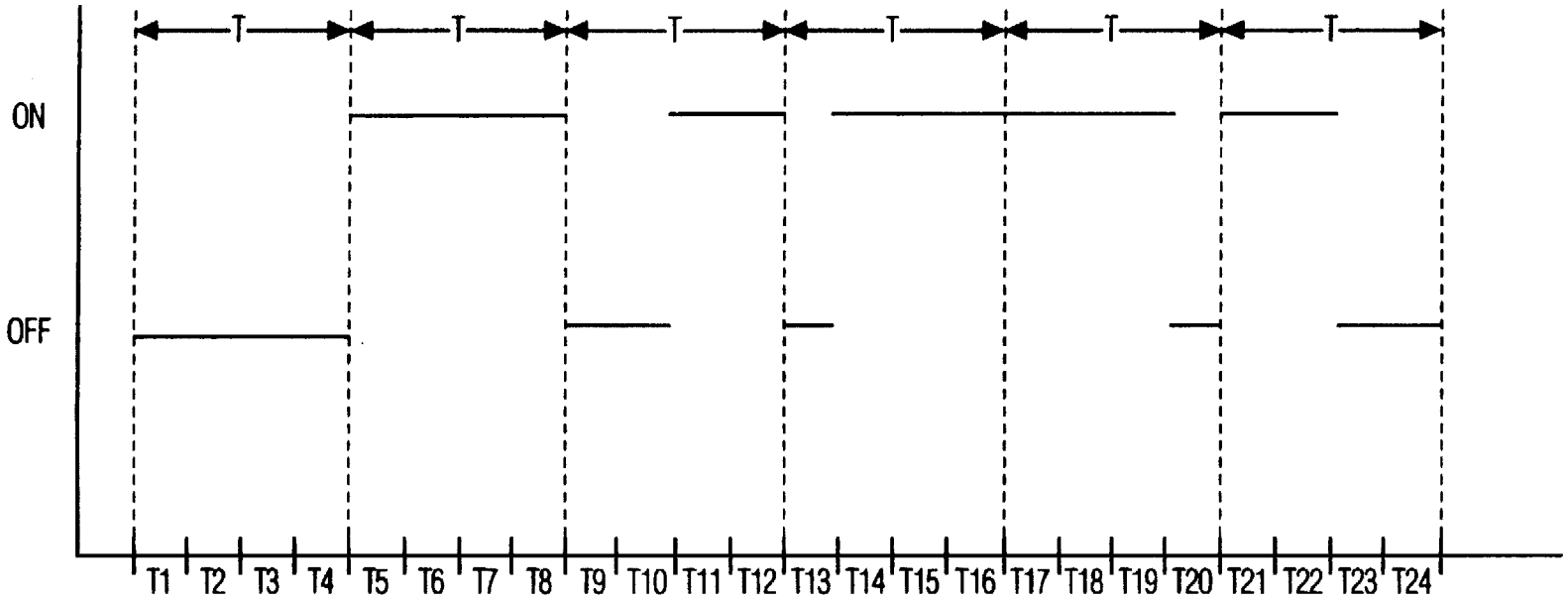
FIG. 3 PRIOR ART
FIG. 3 is a generalized timing diagram showing a prior art method of duty-cycle modulating cells in the deformable mirror device of FIG. 1.

FIGS. 4A–4D illustrate an exemplary method of operation of a DMD in accordance with the invention. In this example, a memory cell having three sub-cells 54,55,56 is associated with each mirror cell $DM_{mn}$, as is illustrated in FIG. 2, for storing three-bit data codes. In practice, the number of bits in each code, and correspondingly the number of memory sub-cells, preferably will be greater, e.g. seven.

Figures 4A, 4B, 4C, 4D:
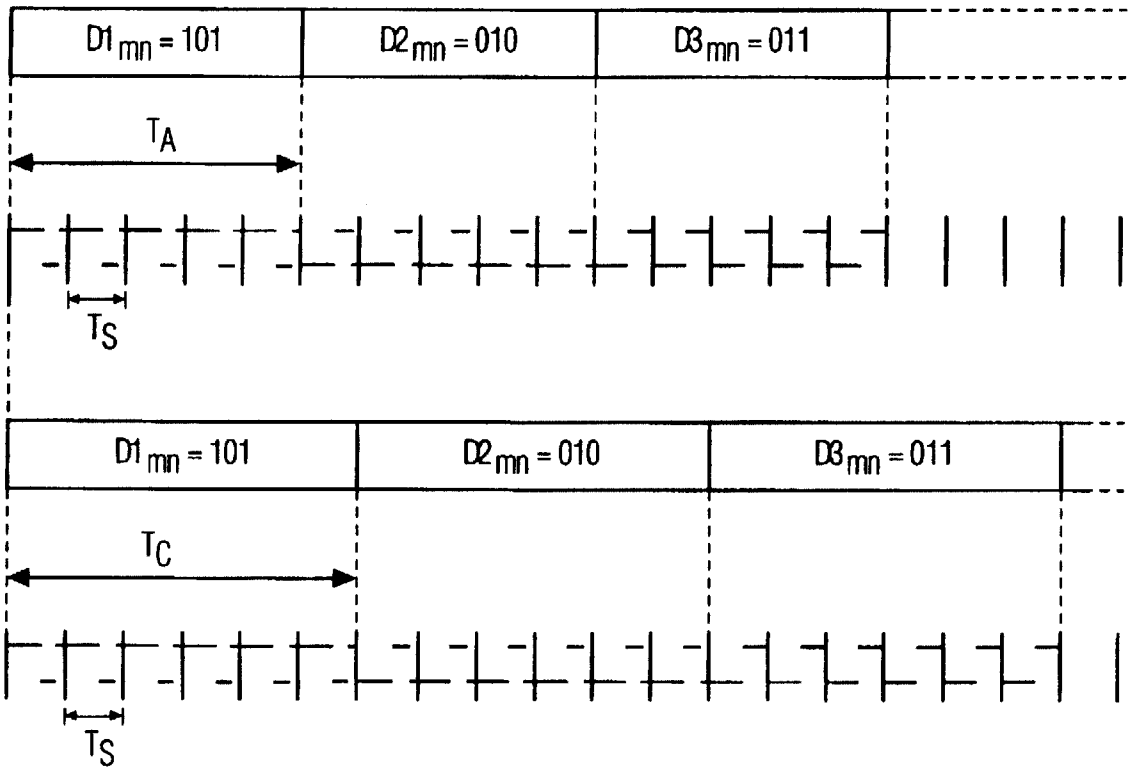
FIGS. 4A–4D are timing diagrams showing operation of a deformable mirror device in accordance with a first embodiment of the invention.

FIGS. 4A and 4C illustrate the production by different sources of a succession of three-bit binary display codes $D1_{mn}$,$D2_{mn}$,$D3_{mn}$, at respective frame rates, for the activation of mirror cell $DM_{mn}$ in three successive frames. In this example, the frame rate in FIG. 4A is 72 Hz (e.g. from a computer) while the frame rate in FIG. 4C is 60 Hz (e.g. from a television broadcast source). The frame periods corresponding to these frame rates have the respective durations $T_A$=1/72 second (13.9 ms) and $T_c$=1/60 second (16.7 ms), respectively. The DMD successively stores these codes, from either of the sources, in a portion of the register 18 associated with the column line $C_n$. The codes are stored in the register at whichever frame rate they are received. Simultaneously, codes for activation of each of the other mirror cells in the array are successively stored in a respective portion of the register 18 associated with the column line for that cell.

FIGS. 4B and 4D illustrate how the codes $D1_{mn}$, $D2_{mn}$, $D3_{mn}$, for activating mirror cell $DM_{mn}$ are processed after they are stored in the register 18. That is, the DMD activates the mirror cell for each code at a subframe rate of 360 Hz, which is the lowest integral multiple of the 60 and 72 Hz frame rates. Thus, each subframe has a period $T_S$ of duration 1/360 second (2.8 ms). Note that, while in this simple example only two different source frame rates are considered, the DMD could be readily adapted to receive data at significantly more than two different rates by utilizing a different subframe rate which is an integral multiple of all of the frame rates. For example, if display codes from a third source are also to be received at a frame rate of 24 Hz (commonly used in motion-picture films), the same subframe rate of 360 Hz could be used.

Note that FIGS. 4B and 4D show the entire 2.8 ms duration of each subframe period $T_S$ as being utilized to activate the associated mirror cell $DM_{mn}$, i.e. to READ the three bit codes which are successively stored in the respective memory cell 54,55,56. In practice, time must also be allotted to WRITE each of the codes $D1_{mn}$, $D2_{mn}$, $D3_{mn}$, . . . into the memory cell. A first approach is to both WRITE and READ the respective code during each subframe period $T_S$. This, however, requires a high WRITE speed, because the time allotted to WRITE each code in the memory cell would ideally occupy only a small portion of each subframe relative to the portion utilized for READING (i.e. activating the associated mirror). A second approach is to utilize one of the subframe periods $T_S$ to WRITE the code into the memory cell and to utilize the remaining subframe periods $T_S$ to repeatedly activate the mirror cell. In either approach, the mirror cell is activated at the rate $1/T_S$.

Figure 5:
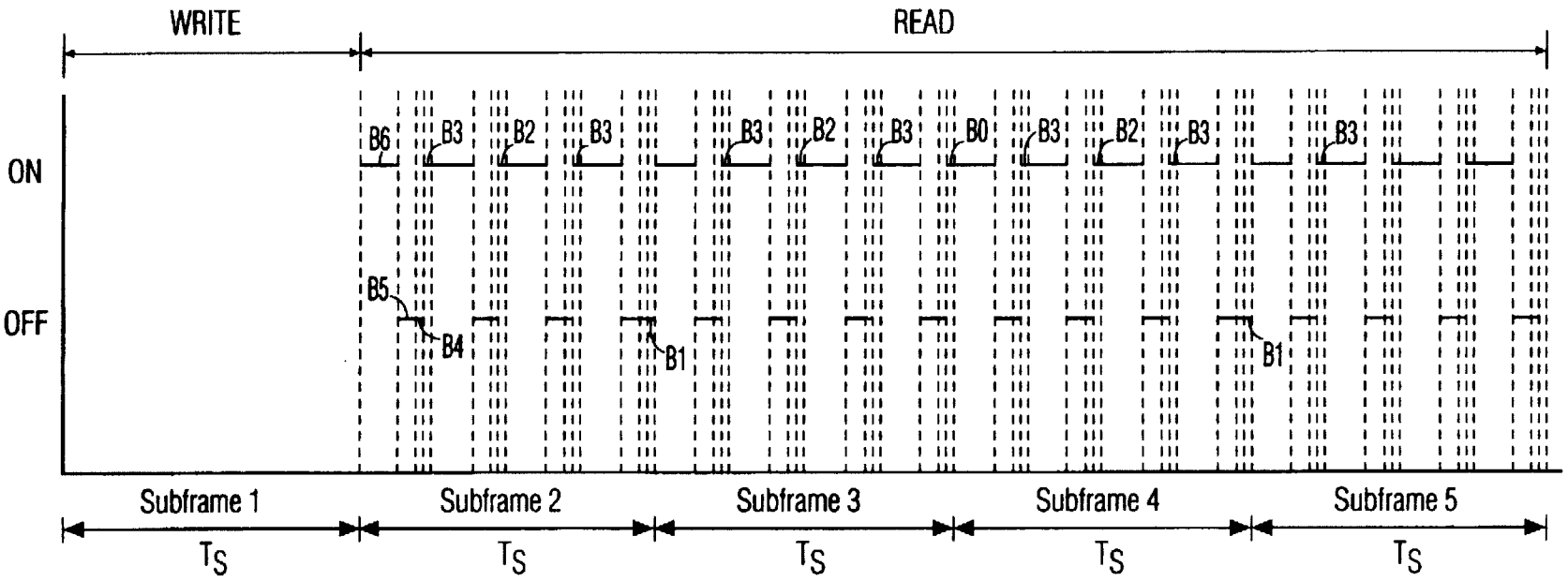
FIG. 5 is a timing diagram showing operation of a deformable mirror device in accordance with a second embodiment of the invention.

FIG. 5 illustrates how the second approach can be utilized to activate each mirror cell in accordance with a modified form of a data code stored in its associated memory cell, i.e. in a distributed duty cycle sequence which makes use of the invention claimed in U.S. patent application Ser. No. 08/495,290 (PHA 21992). In this example, it is presumed that a 72 Hz source is providing seven-bit binary display codes $B_6B_5B_4B_3B_2B_1B_0$ to the DMD during each period of duration $T_A$, and that the code $B_6B_5B_4B_3B_2B_1B_0$=1001101 has been stored in a portion of the register 18 associated with the column line $C_n$. As in the example of FIG. 4B, five subframes of duration $T_S$ are available for storing the code in the memory cell and activating the associated mirror cell $DM_{mn}$. During the first of these subframes, i.e. subframe 1, the code is stored in the memory cell. In each of the next four of these subframes, i.e. subframes 2 through 5, the digital light modulating mirror is modulated with a modified form of the code. That is:

During subframe 2, the mirror is modulated in accordance with the states of the bits $B_6B_5B_4B_3B_2B_1$ for the relative durations illustrated.

During subframe 3, the mirror is modulated in accordance with the states of the bits $B_6B_5B_4B_3B_2B_0$ for the relative durations illustrated.

During subframe 4, the mirror is modulated in accordance with the states of the bits $B_6B_5B_4B_3B_2B_1$ for the relative durations illustrated.

During subframe 5, the mirror is modulated in accordance with the states of the bits $B_6B_5B_4B_3B_2$ for the relative durations illustrated.

Figure 6:
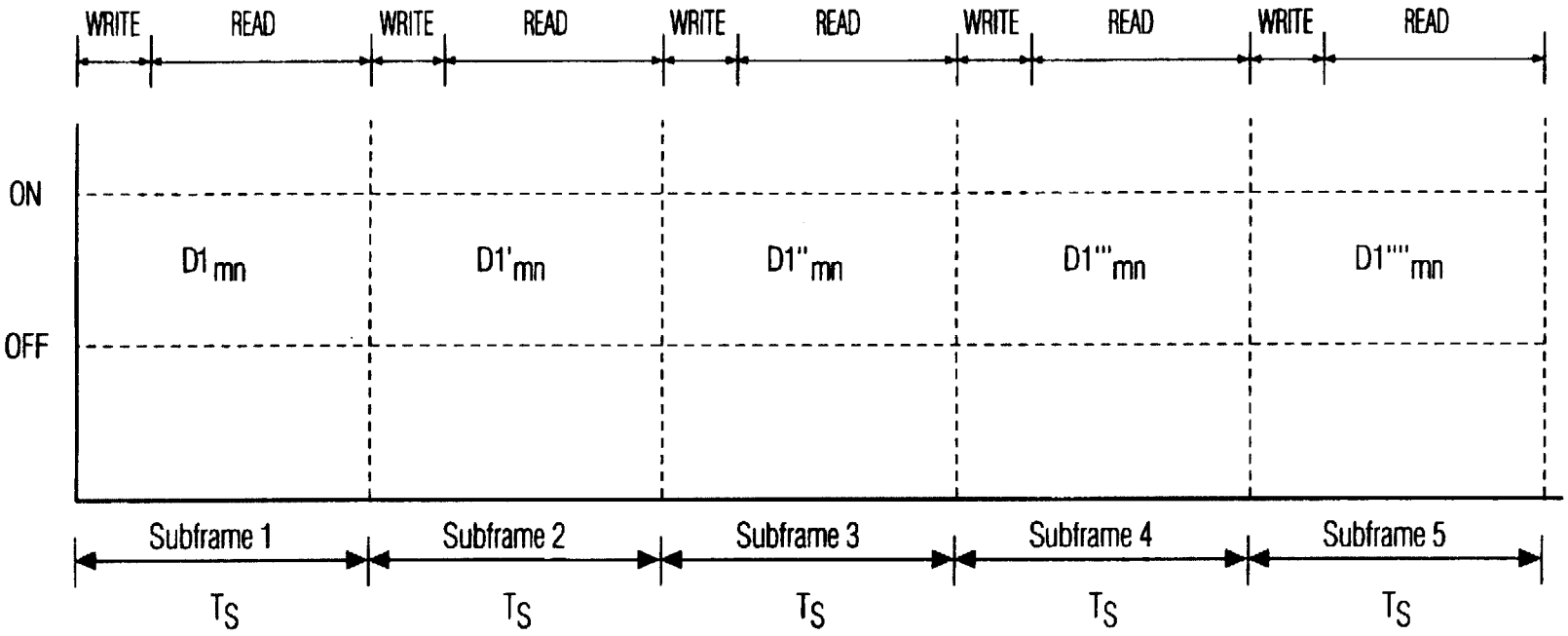
FIG. 6 is a timing diagram showing operation of a deformable mirror device in accordance with a third embodiment of the invention.

FIG. 6 illustrates another approach for activating each mirror cell in accordance with a modified form of a data code. In this approach, a data code is both WRITTEN into and READ from the respective memory cell during each subframe, but the code is modified in each of subframes 2 through 5. This approach is particularly useful for performing filtering functions such as temporal filtering where interpolated codes are produced by combining data codes from different frame periods.

In the example of FIG. 6, a code $D1_{mn}$, received at the 72 Hz rate represented by FIG. 4A, is WRITTEN/READ identically or in interpolated form (combining $D1_{mn}$ and $D2_m$) during each of five subframe periods of duration $T_S$, as follows:

During subframe 1, the code $D1_{mn}$ is WRITTEN (stored) in the memory cell and then READ by activating the associated mirror cell in accordance with the states of the bits of the code $D1_{mn}$ for durations corresponding to the respective weights of the bits.

During subframe 2 the code $D1'_{mn}$ (having the interpolated value 4/5 $D1_{mn}$+1/5 $D2_m$) is WRITTEN in the memory cell and then READ by activating the associated mirror cell in accordance with the states of the bits of the code $D1'_{mn}$ for durations corresponding to the respective weights of the bits.

During subframe 3, the code $D1''_{mn}$ (having the interpolated value 3/5 $D1_{mn}$+2/5 $D2_{mn}$) is WRITTEN in the memory cell and then READ by activating the associated mirror cell in accordance with the states of the bits of the code $D1''_{mn}$ for durations corresponding to the respective weights of the bits.

During subframe 4 the code $D1'''_{mn}$ (having the interpolated value 2/5 $D1_{mn}$+3/5 $D2_{mn}$) is WRITTEN in the memory cell and then READ by activating the associated mirror cell in accordance with the states of the bits of the code $D1'''_{mn}$ for durations corresponding to the respective weights of the bits.

During subframe 5, the code $D1''''_{mn}$ (having the value 1/5 $D1_{mn}$+4/5 $D2_{mn}$) is WRITTEN in the memory cell and then READ by activating the associated mirror cell in accordance with the states of the bits of the code $D1_{mn}$ for durations corresponding to the respective weights of the bits.

Figure 7A:
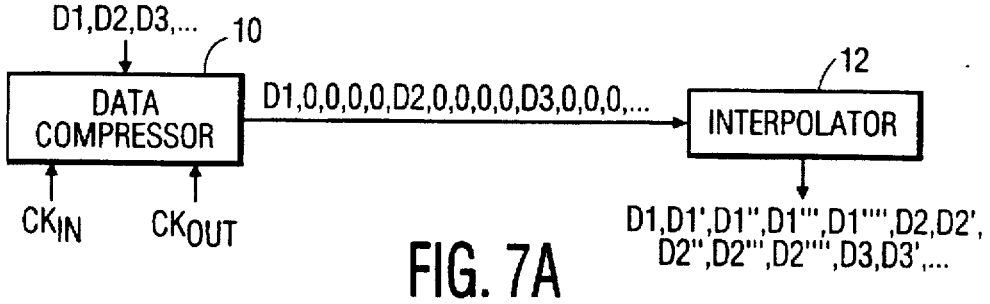
FIGS. 7A and 7B illustrate an apparatus for producing interpolated data for operating a deformable mirror device in accordance with the third embodiment of the invention.

FIG. 7A illustrates one embodiment of an arrangement for producing such interpolated codes. The arrangement includes a data compressor 10 for dividing each received frame period into a plurality of subframes and an interpolator 12 for inserting interpolated codes into some of the subframes. In the specific example shown, the data compressor receives data codes D1,D2,D3, . . . at an input clock rate $CK_{IN}$ (e.g. 72 Hz), divides each frame period into five subframes by producing output data subframes at an output clock rate $CK_{OUT}$=5 $CK_{IN}$, and inserts the received data codes into the first of each five subframes, while leaving the remaining four subframes free for interpolated codes. In FIG. 7A the data compressor inserts all ZEROES in the remaining subframes, but the values of these codes may be any Value, because they will be replaced in the interpolator by the codes D1',D1",D1'",D1"".

Figure 7B:
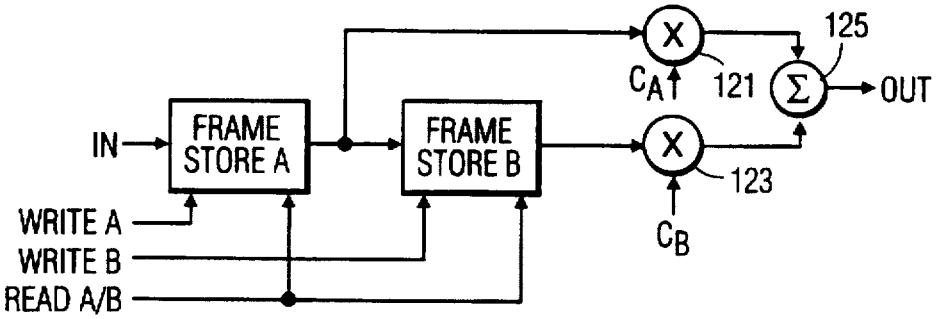

FIG. 7B illustrates an exemplary embodiment of the interpolator 12. In this embodiment, the interpolator includes frame stores A and B for sequentially storing the data codes D1,D2,D3, . . . inserted by the data compressor 10 into each of the first subframes, digital multipliers 121, 123, and a digital summer 125. Multiplier 121 has a first input for receiving data stored in frame store A and a second input for receiving a time-varying digital coefficient signal $C_A$. Similarly, multiplier 123 has a first input for receiving data stored in frame store B and a second input for receiving a time-varying digital coefficient signal $C_B$. Digital summer 125 has first and second inputs, for receiving products produced by the multipliers, and produces sums of these products at its output.

Figure 7C:
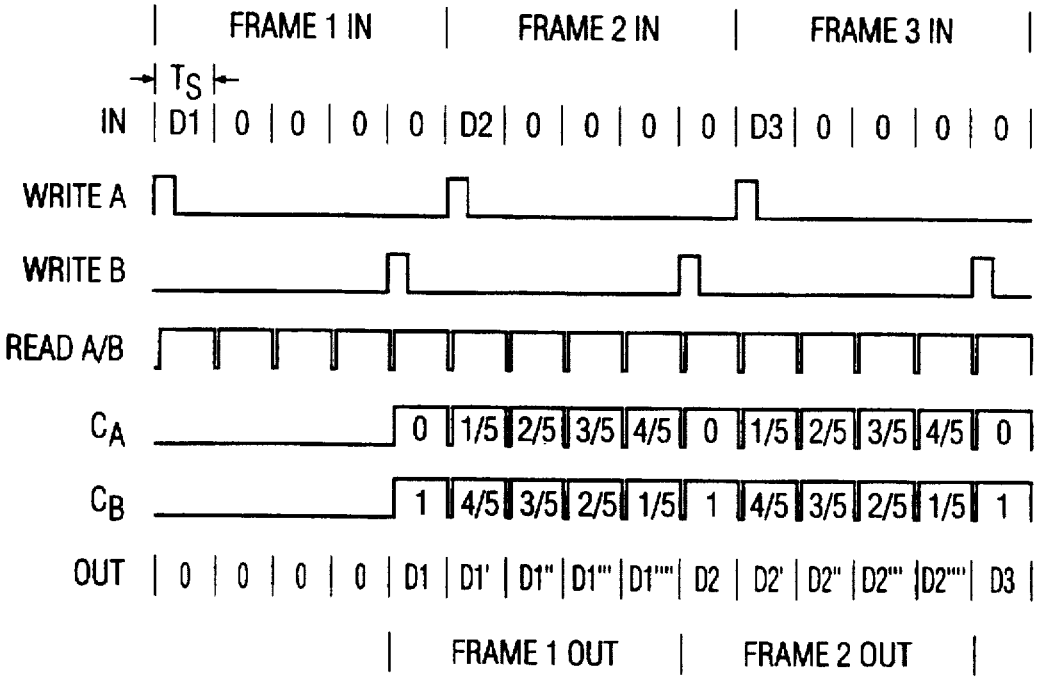
FIG. 7C is a timing diagram showing operation of the apparatus of FIGS. 7A and 7B.

FIG. 7C is a timing diagram demonstrating how the interpolator of FIG. 7B may be operated while receiving data from the data compressor 10 of FIG. 7A. During every subframe a READ A/B pulse is applied to both frame stores to effect appearance at their respective outputs of whatever data is contained in these stores. During initialization, however, i.e. during the first four subframes of Frame 1 In, when no data has yet been stored in frame store B, the time-varying coefficients $C_A$ and $C_B$ have continuous zero values to effect production of a continuous zero-value code at the output of the summer 125. Initialization includes application of a WRITE A pulse to frame store A, during the first subframe of Frame 1 In, when the code D1 is applied to the input of the interpolator, to effect storage of this code.

Following initialization, operation of the interpolator proceeds as follows:

During the fifth subframe of Frame 1 In (corresponding to the first subframe of Frame 1 Out produced by the interpolator), a WRITE B pulse is applied to frame store B to effect copying of the code D1 into store B, such that the code D1 is now stored in both frame stores. Also during this subframe, the coefficients $C_A$ and $C_B$ have the values 0 and 1, respectively. The READ A/B pulse occurring during this subframe causes the code D1 to be applied by the frame stores to both multipliers, resulting in production by the summer of the output (0)D1+(1)D1=D1.

During the first subframe of Frame 2 In (corresponding to the second subframe of Frame 1 Out), a WRITE A pulse is produced while the code D2 is applied to the input of the interpolator to effect storage of this code in frame store A. The READ A/B pulse occurring during this subframe causes the code D2 stored in frame store A and the code D1 stored in frame store B to be applied to the first inputs of multipliers 121 and 123, respectively. Also during this subframe, the coefficients $C_A$ and $C_B$ have the values 1/5 and 4/5, respectively, such that the summer produces the code D1'=1/5 D2+4/5 D1.

During the second through fourth subframes of Frame 2 In (corresponding to the third through fifth subframes of Frame 1 Out), the coefficients change as illustrated in FIG. 7C to successively effect production at the summer output of the codes D1"=2/5 D2+3/5 D1, D1'"=3/5 D2+2/5 D1, and D1""=4/5 D2+1/5 D1.

During the fifth subframe of Frame 2 In (corresponding to the first subframe of Frame 2 Out) the interpolation process repeats the above-described steps, but now for production of the codes D2, D2', D2', 'D'", D2"", D3 . . .

We claim:

1. A method of operating a display apparatus comprising a light source, a screen for displaying successive images represented by respective sets of multi-bit codes successively received by said apparatus during respective frame periods at a predetermined frame rate, an array of digital light modulating elements interposed in an optical path between the light source and the screen, and means for activating each of the digital light modulating elements into either a first state, in which said element enables the light to illuminate a corresponding pixel of an image area of the display screen, or a second state, in which said element impedes the light from illuminating said pixel, said method comprising:

a. successively storing the sets of multi-bit codes in memory means at the received frame rate, each of said codes being associated with a respective one of the digital light modulating elements; and b. reading each of the codes from the memory means during a plurality of subframes at a subframe rate which is an integral multiple of the predetermined frame rate and activating the respective digital light modulating element into the states represented by said read codes.

2. A method of operating a display apparatus comprising a light source, a screen for displaying successive images represented by respective sets of multi-bit codes successively received by said apparatus during respective frame periods at one of a plurality of different frame rates, an array of digital light modulating elements interposed in an optical path between the light source and the screen, and means for activating each of the digital light modulating elements into either a first state, in which said element enables the light to illuminate a corresponding pixel of an image area of the display screen, or a second state, in which said element impedes the light from illuminating said pixel, said method comprising:

a. successively storing the sets of multi-bit codes in memory means at the received frame rate, each of said codes being associated with a respective one of the digital light modulating elements; and b. reading each of the codes from the memory means during a plurality of subframes at a subframe rate which is an integral multiple of each of the different frame rates and activating the respective digital light modulating element into the states represented by said read codes.

3. A method as in claim 1 or 2 where the codes are read from the memory means in a modified form.

4. A method as in claim 3 where the codes are read from the memory means in a distributed duty cycle sequence.

5. A method as in claim 3 where the codes are read from the memory means in a sequence for effecting temporal filtering.

6. A method as in claim 1 or 2 where the respective digital light modulating element is activated into the states represented by said read codes during each of said subframes.

* * * * *